US011297413B2

(12) United States Patent
Wang et al.

(10) Patent No.: US 11,297,413 B2
(45) Date of Patent: Apr. 5, 2022

(54) INVERTER VENT AND LOUDSPEAKER

(71) Applicant: Wistron Corporation, New Taipei (TW)

(72) Inventors: Yao-Wei Wang, New Taipei (TW); Li-Ping Pan, New Taipei (TW); Ting-Yao Cheng, New Taipei (TW); Hsin-Chi Chen, New Taipei (TW); Li-Ren Wang, New Taipei (TW); Jing-Hong Lu, New Taipei (TW); Fei-Ta Chen, New Taipei (TW); Ya-Shian Huang, New Taipei (TW); Wei-Ting Chen, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 16/813,567

(22) Filed: Mar. 9, 2020

(65) Prior Publication Data

US 2021/0185431 A1 Jun. 17, 2021

(30) Foreign Application Priority Data

Dec. 12, 2019 (TW) ..... 108145513

(51) Int. Cl.

| | |
|---|---|
| ***H04R 1/30*** | (2006.01) |
| ***H04R 1/28*** | (2006.01) |
| ***H04R 1/02*** | (2006.01) |
| ***H04R 7/12*** | (2006.01) |

(52) U.S. Cl.

CPC ..... *H04R 1/2826* (2013.01); *H04R 1/025* (2013.01); *H04R 7/12* (2013.01)

(58) Field of Classification Search

CPC ..... H04R 1/30; H04R 1/2861; H04R 1/2865; H04R 2201/34; H04R 1/28

USPC ..... 381/340–341, 343, 350, 352, 160, 349

See application file for complete search history.

(56) References Cited

U.S. PATENT DOCUMENTS

| | | | | |
|---|---|---|---|---|
| 1,943,499 A * | 1/1934 | Williams | H04R 1/2865 | 181/159 |
| 3,816,672 A * | 6/1974 | Gefvert | H04R 1/345 | 381/352 |
| 4,168,761 A | 9/1979 | Pappanikolaou | | |
| 4,310,065 A * | 1/1982 | Kayman | G10K 11/025 | 181/159 |

(Continued)

FOREIGN PATENT DOCUMENTS

| | | |
|---|---|---|
| CN | 203675294 U | 6/2014 |
| EP | 2779692 A2 | 9/2014 |

(Continued)

OTHER PUBLICATIONS

European Search Report dated Sep. 8, 2020 in related European Application No. 20166278.0.

(Continued)

*Primary Examiner* — Suhan Ni

(74) *Attorney, Agent, or Firm* — Donald E. Stout; Stout, Uxa & Buyan, LLP

(57) ABSTRACT

Embodiments of the present disclosure provide an inverter vent and a loudspeaker having the same. Preferably, air flows within the inverted vent in a 360 degrees full-circumferential direction. This design can improve the efficiency of the loudspeaker, reduce the wind noise, and increase the bass ductility.

14 Claims, 13 Drawing Sheets

(56) References Cited

U.S. PATENT DOCUMENTS

| | | | | | |
|---|---|---|---|---|---|
| 4,348,549 | A * | 9/1982 | Berlant | H04R 1/26 | 181/152 |
| 4,434,507 | A * | 2/1984 | Thomas | H04R 1/083 | 381/122 |
| 4,908,601 | A * | 3/1990 | Howze | G08B 3/00 | 181/144 |
| 5,809,154 | A * | 9/1998 | Polk | H04R 1/2826 | 181/156 |
| 5,995,634 | A * | 11/1999 | Zwolski | H04R 1/028 | 181/155 |
| 8,824,718 | B2 * | 9/2014 | Held | H04R 1/345 | 381/340 |
| 2005/0018868 | A1 * | 1/2005 | Chick | H04R 1/2834 | 381/349 |
| 2005/0175206 | A1 | 8/2005 | Bearden | | |
| 2017/0006373 | A1 | 1/2017 | Bruss | | |

FOREIGN PATENT DOCUMENTS

| | | | |
|---|---|---|---|
| EP | 3544315 | A1 | 9/2019 |
| TW | I420913 | B | 3/2011 |
| WO | 96/06514 | A1 | 2/1996 |
| WO | WO2018/167908 | A1 | 9/2018 |

OTHER PUBLICATIONS

Office Action dated Jan. 11, 2021 in corresponding Taiwan Patent Application No. 108145513.

* cited by examiner

INVERTER VENT AND LOUDSPEAKER

CROSS-REFERENCE TO RELATED APPLICATIONS

The entire contents of Taiwan Patent Application No. 108145513, filed on Dec. 12, 2019, from which this application claims priority, are expressly incorporated herein by reference.

BACKGROUND OF THE INVENTION

1. Field of the Invention

The present disclosure relates to an inverter vent and a loudspeaker having the same.

2. Description of Related Art

An inverter tube is typically a hollow tube arranged in a loudspeaker and serves as a communication channel for the exterior and interior of the loudspeaker. The inverter tube of the existing loudspeaker is usually a single hollow cylinder arranged horizontally or upright. For example, Taiwan patent TWI420913B discloses a bass reflex loudspeaker, in which an upright hollow cylindrical inverter tube is connected to a cavity of the loudspeaker.

FIGS. 1A and 1B are schematic diagrams of a conventional loudspeaker 1. Referring to FIGS. 1A and 1B, the loudspeaker 1 includes a monomer 10 and an inverter tube 11 horizontally arranged in the loudspeaker 1.

Referring to FIGS. 1A and 1B, when the monomer 10 is working, its diaphragm 101 vibrates. As shown in FIG. 1A, when the diaphragm 101 vibrates inward, the air in the loudspeaker 1 is squeezed outward through the inverter tube 11. As shown in FIG. 1B, when the diaphragm 101 vibrates outward, the air outside the loudspeaker 1 is sucked into the inverter tube 11. Therefore, when the diaphragm 101 vibrates repeatedly, the air in the speaker 1 will flow back and forth in the inverter tube 11. Regardless of the flow direction, the total volume of air is the same.

However, due to the mechanism design of the speaker 1, an air inlet 111 or an air outlet 112 of the inverter tube 11 is probably blocked by the mechanism of the loudspeaker 1. For example, FIGS. 1A and 1B show that a portion of the air outlet 112 of the inverter tube 11 is blocked by an obstacle 12. When the air outlet 112 or the air inlet 111 of the inverter tube 11 is blocked by the obstacle 12 and the portion to be blocked is too large, the cross-sectional area allowing for the air flow suddenly becomes smaller, such that air can only flow back and forth in the restricted space and this will result in wind noise.

On the other hand, in order to match the product design of the loudspeaker 1, the required length of the inverter tube 11 is often insufficient and hence leads to a poor bass ductility.

SUMMARY OF THE INVENTION

One of the objectives of the present disclosure is to design an inverter vent that is not easily affected by the mechanism of the speaker.

According to an embodiment of the present disclosure, an inverter vent is provided in a loudspeaker and comprises a 360 degrees full-circumferential first opening, a channel, and a second opening. The channel is connected to the first opening, and the second opening is connected to the channel Wherein, air inside the loudspeaker enters the first opening in a 360° full-circumferential direction, passes through the channel, and then is discharged through the second opening. Alternatively, air outside the loudspeaker enters the second opening, passes through the channel, and then enters the loudspeaker in a 360° full-circumferential direction.

According to an embodiment of the present disclosure, the inverter vent includes a first partition and a second partition, and the first partition and the second partition constitute the first opening, the channel, and the second opening.

In an embodiment, the inverter vent further includes a third partition, and the channel is divided into a first channel and a second channel communicated with each other. The first partition and the second partition constitute the first opening and the first channel, and the second partition and the third partition constitute the second channel and the second opening.

According to an embodiment of the present disclosure, a loudspeaker comprises a monomer having a diaphragm and an inverter vent of the foregoing embodiments.

DETAILED DESCRIPTION OF THE PREFERRED EMBODIMENT

Reference will now be made in detail to those specific embodiments of the disclosure. Examples of these embodiments are illustrated in accompanying drawings. While the disclosure will be described in conjunction with these specific embodiments, it will be understood that it is not intended to limit the disclosure to these embodiments. On the contrary, it is intended to cover alternatives, modifications, and equivalents as may be included within the spirit and scope of the disclosure as defined by the appended claims. In the following description, numerous specific details are set forth in order to provide a thorough understanding of the present disclosure. The present disclosure may be practiced without some or all of these specific details. In other instances, well-known process operations and components are not described in detail in order not to unnecessarily obscure the present disclosure. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1A:
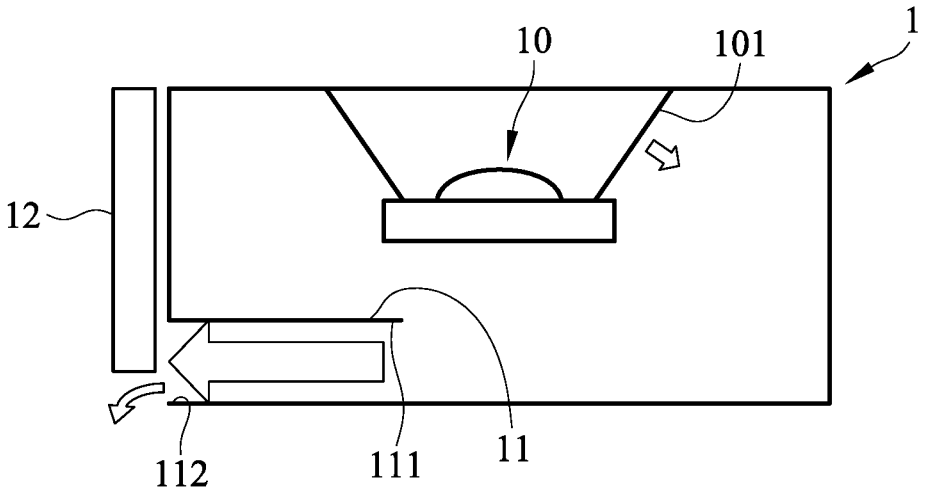
FIGS. 1A and 1B are schematic diagrams showing a conventional loudspeaker.
Figure 1B:
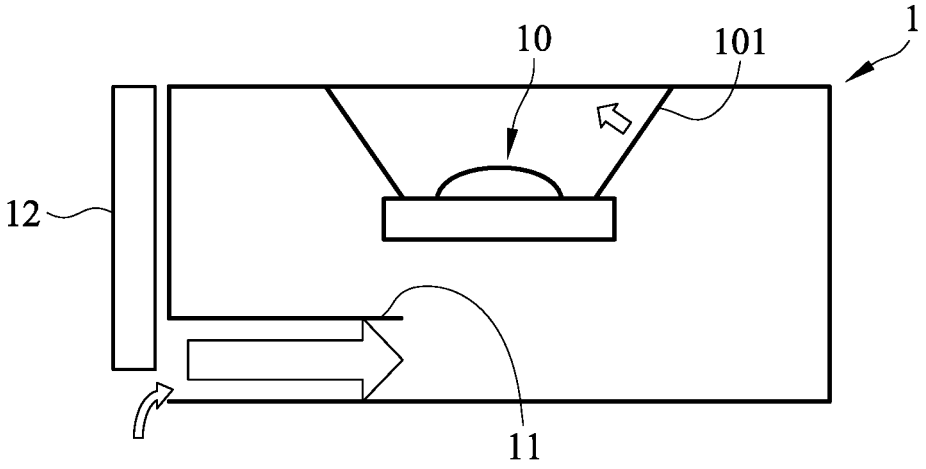
Figure 2A:
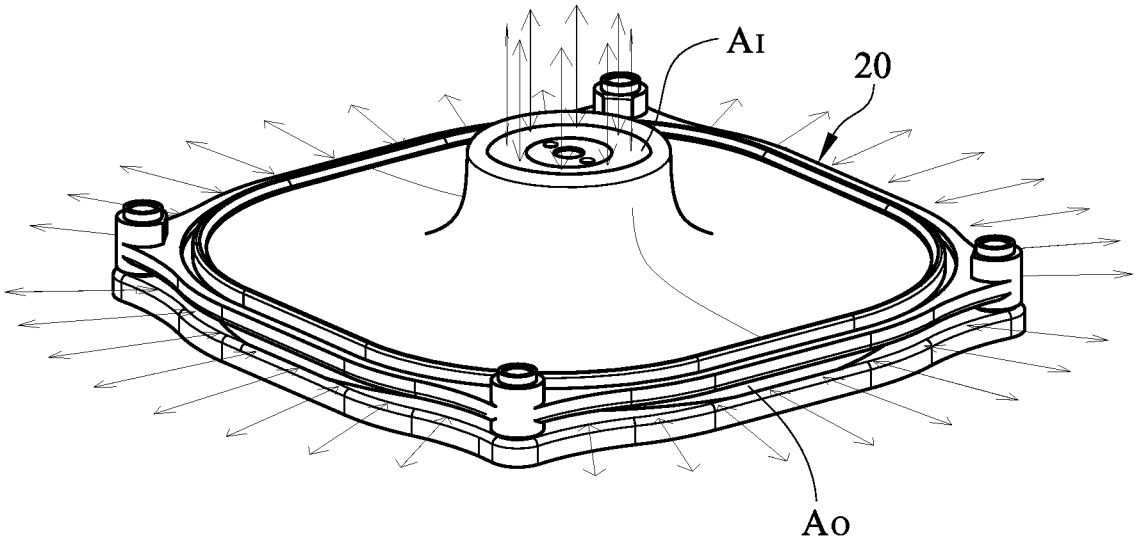
FIG. 2A is a perspective view of an inverter vent in accordance with an embodiment of the present disclosure.
Figure 2B:
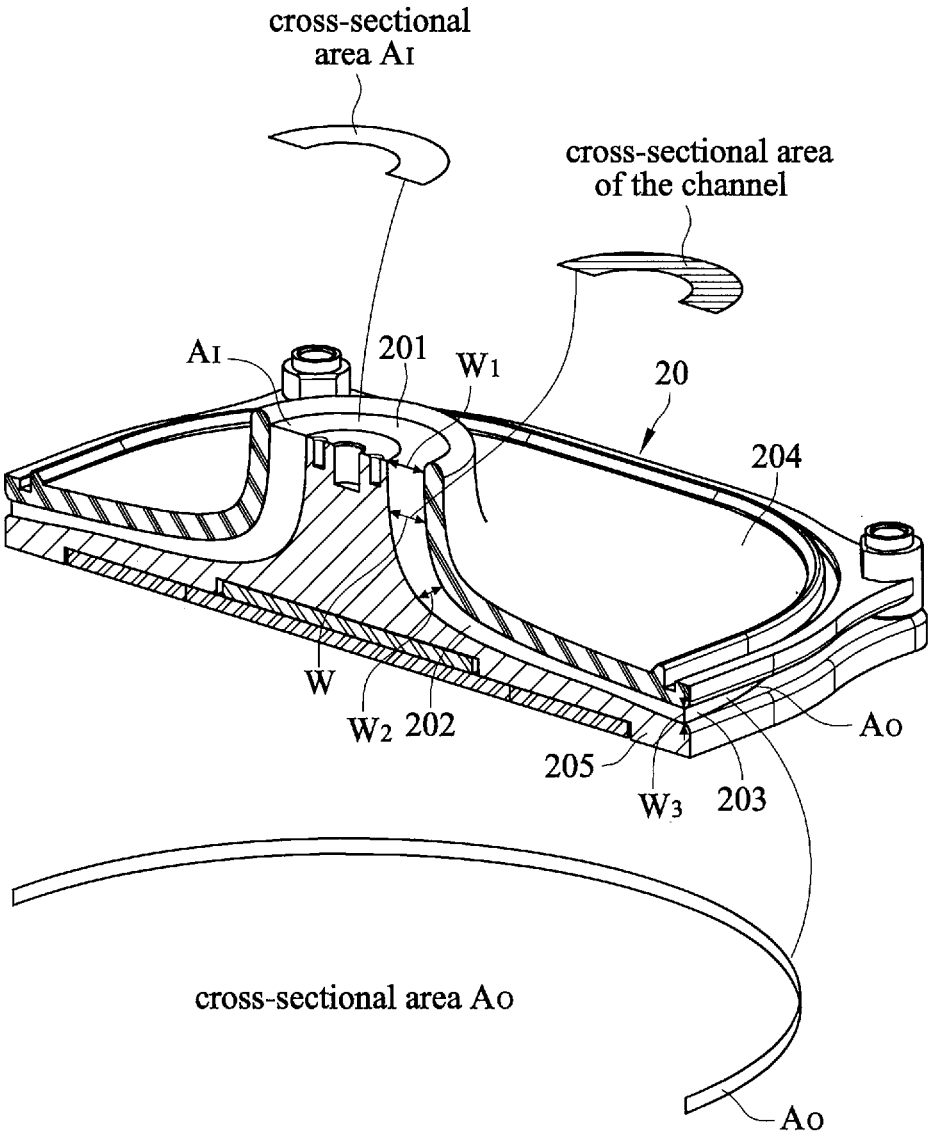
FIG. 2B is a cross-sectional view of the inverter vent shown in FIG. 2A.
Figure 2C:
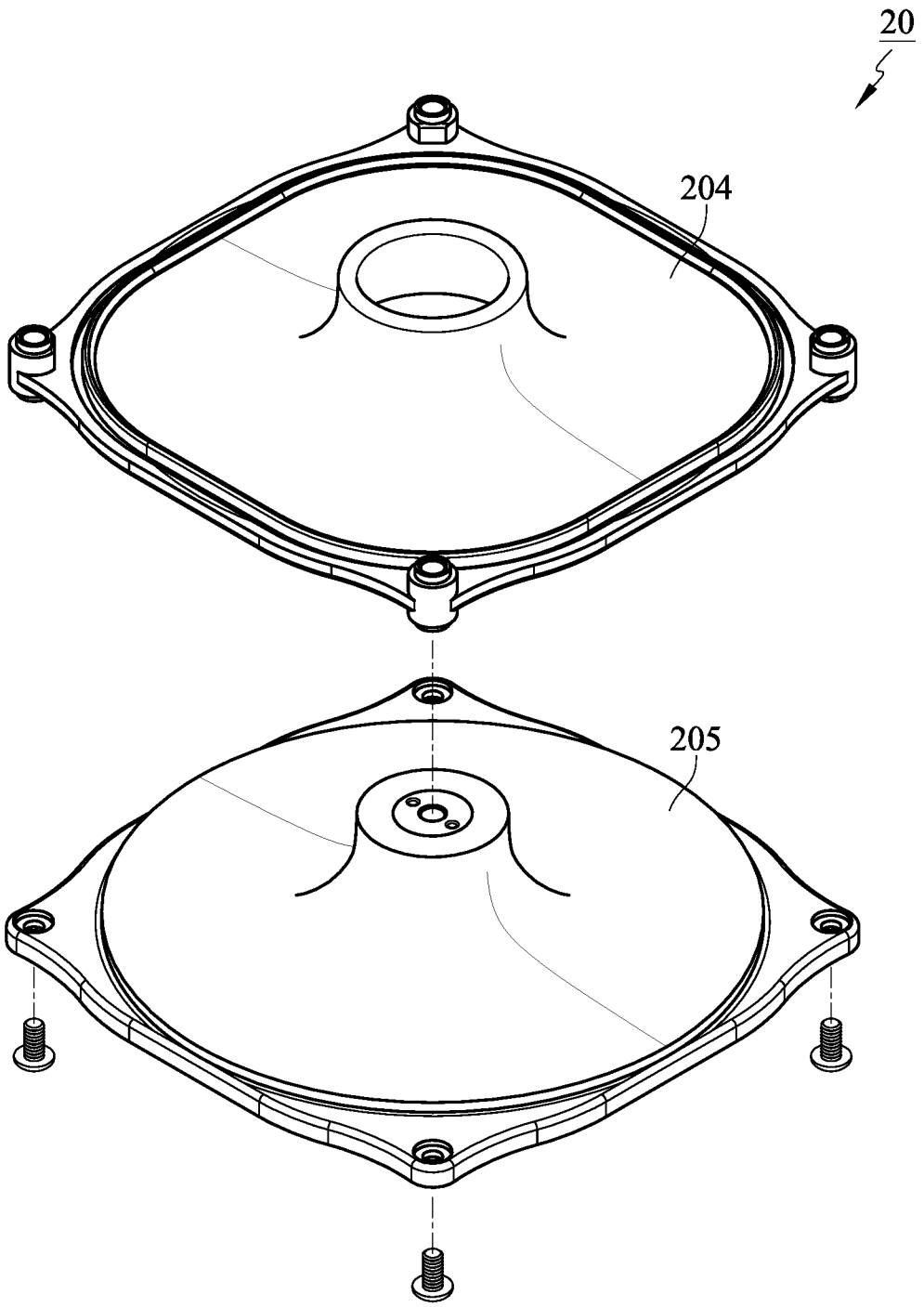
FIG. 2C is an exploded view of the inverter vent shown in FIG. 2A.
Figure 2D:
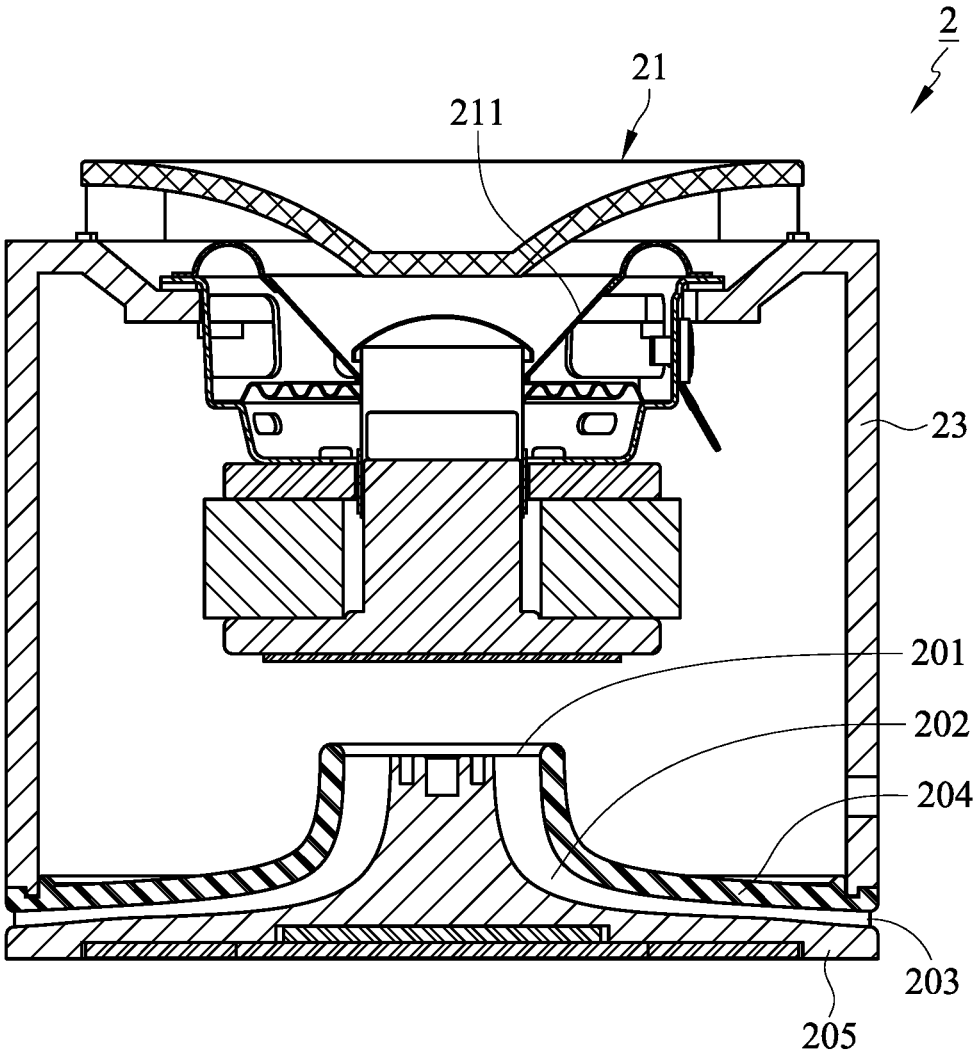
FIG. 2D is a cross-sectional view of a loudspeaker having the inverter tube shown in FIG. 2A in accordance with an embodiment of the present disclosure.

FIGS. 2A, 2B, and 2C are perspective view, cross-sectional view, and exploded view of an inverter vent 20 in accordance with an embodiment of the present disclosure, respectively. FIG. 2D shows a loudspeaker 2 having the inverter vent 20 in accordance with an embodiment of the present disclosure.

Referring to FIGS. 2A-2D, the inverter vent 20 is disposed in the loudspeaker 2. The inverter vent 20 comprises a 360° full-circumferential first opening 201, a channel 202, and a second opening 203. The channel 202 is communicated with the first opening 201 and the second opening 203 is communicated with the channel 202. In this context, "a 360° full-circumferential opening" means that a flow direction of air that enters leaves the opening is 360° around the circumference of the opening. Preferably, a 360° full-circumferential opening is an annular opening, such as a ring-shaped or a cylinder-shaped opening, but is not limited thereto.

The loudspeaker 2 is provided with at least one monomer 21, which may include a diaphragm 211. When the diaphragm 211 vibrates inward, the air inside the loudspeaker 2 enters the first opening 201 in a 360° full-circumferential direction, passes through the channel 202, and then is discharged through the second opening 203. When the diaphragm 211 vibrates outward, air outside of the loudspeaker 2 enters the second opening 203, passes through the channel 202, and then enters the loudspeaker 2 through the first opening 201 in a 360° full-circumferential direction.

Notice should be made that, as shown by the double-headed arrow in FIG. 2A, air inside the loudspeaker 2 enters the first opening 201 in a 360° full-circumferential direction. Alternatively, air outside the loudspeaker 2 enters the loudspeaker 2 through the first opening 201 in a 360° full-circumferential direction, too.

In this embodiment, preferably, the second opening 203 is also a 360° full-circumferential opening. As shown by the double-headed arrow in FIG. 2A, air inside the loudspeaker is discharged from the second opening 203 in a 360° full-circumferential direction. Alternatively, air outside the loudspeaker enters the second opening 203 in a 360° full-circumferential direction, too. In an embodiment, in order to match the product design of the loudspeaker 2 or for other reasons, the direction that air is discharged from or entered into the second opening 203 may not be in a 360° full-circumferential direction.

As used herein, "cross-sectional area" refers to the area of a surface orthogonal to the direction of air flow. As shown in FIGS. 2A and 2B, in this embodiment, the cross-sectional area $A_I$ of the first opening 201 and the cross-sectional area $A_O$ of the second opening 203 of the inverter vent 20 are circular and cylindrical, respectively.

In one embodiment, preferably, a cross-sectional area of the channel 202 at its any position is substantially the same as a cross-sectional area of the first opening 201. In one embodiment, preferably, the second opening 203 has a cross-sectional area substantially the same as that of the first opening 201. That is, the cross-sectional area $A_I$ is substantially equal to the cross-sectional area $A_O$. In one embodiment, the first opening 201, the channel 202, and the second opening 203 have substantially the same cross-sectional area. The term "substantially" described in the specification or claims of the present application should at least be construed in light of the number of recited significant digits and by applying ordinary rounding techniques. One cross-sectional area is "substantially the same" as another means that the difference between both the two cross-sectional areas and a theoretical cross-sectional area is within a tolerance, and the tolerance is determined based on the dimension of the loudspeaker, parameters of monomer, and/or experiment results.

In one embodiment, the required length of the channel 202 and the cross-sectional area of the first opening 201, the channel 202, and the second opening 203 can be obtained according to an experimental formula provided by Vance Dickason, 2005, Loudspeaker Design Cookbook (7th Edition):

$$L_V = \frac{1.463 \times 10^7 R^2}{f_B^2 V_B} - 1.463R$$

Where $L_V$ denotes the length (inch) of the inverter vent; $f_B$ denotes the desired frequency (Hz) of the loudspeaker; and VB denotes the radius (inch) of the inverter vent.

According to the above experimental formula, the cross-sectional area and the required length of the inverter vent 20 can be obtained. A loudspeaker can be then design and experimented with the parameters of the monomer 21, where a frequency of the inverter vent 20 is matched with a bass frequency of the monomer 21.

As shown in FIGS. 2A-2C, in this embodiment, the inverter vent 20 comprises a first partition 204 and a second partition 205. The first partition 204 and the second partition 205 constitute the aforementioned first opening 201, the channel 202, and the second opening 203. Notice should be made that, in order to obtain the required length of the channel 202, i.e., a path length that air travels from the first opening 201 to the second opening 203, the first partition 204 and the second partition 205 may be bent, spiral (convoluted) or have other shapes that can increase the path length.

In some embodiments, a width W at the first opening 201, the second opening 203, and any position of the channel 202 may be different from one another. In other words, the distance W between the first partition 204 and the second partition 205 may be a variable. For example, in this embodiment, the diameter of the inverter vent 20 at the second opening 203 is larger than the diameter of the inverter vent 20 at the first opening 201; therefore, in order to have the same cross-sectional area at the two places, the distance W3 between the first partition 204 and the second partition 205 at the second opening 203 is smaller than the distance W1 between the first partition 204 and the second partition 205 at the first opening 201. In addition, the distance W2 between the first partition 204 and the second partition 205 within the range of the channel 202 is less than W1 and greater than W3, i.e., W1>W2>W3. In another embodiment, the inverter vent 20 is constructed to follow the inequality: W3>W2>W1.

Referring to FIG. 2D, in this embodiment, the first partition 204 may be fixed to a wall 23 of the loudspeaker 2 and functions as a bottom of the loudspeaker 2. In addition, several fixing elements, such as screws, may be employed to fix the first partition 204 and the second partition 205.

Figure 3A:
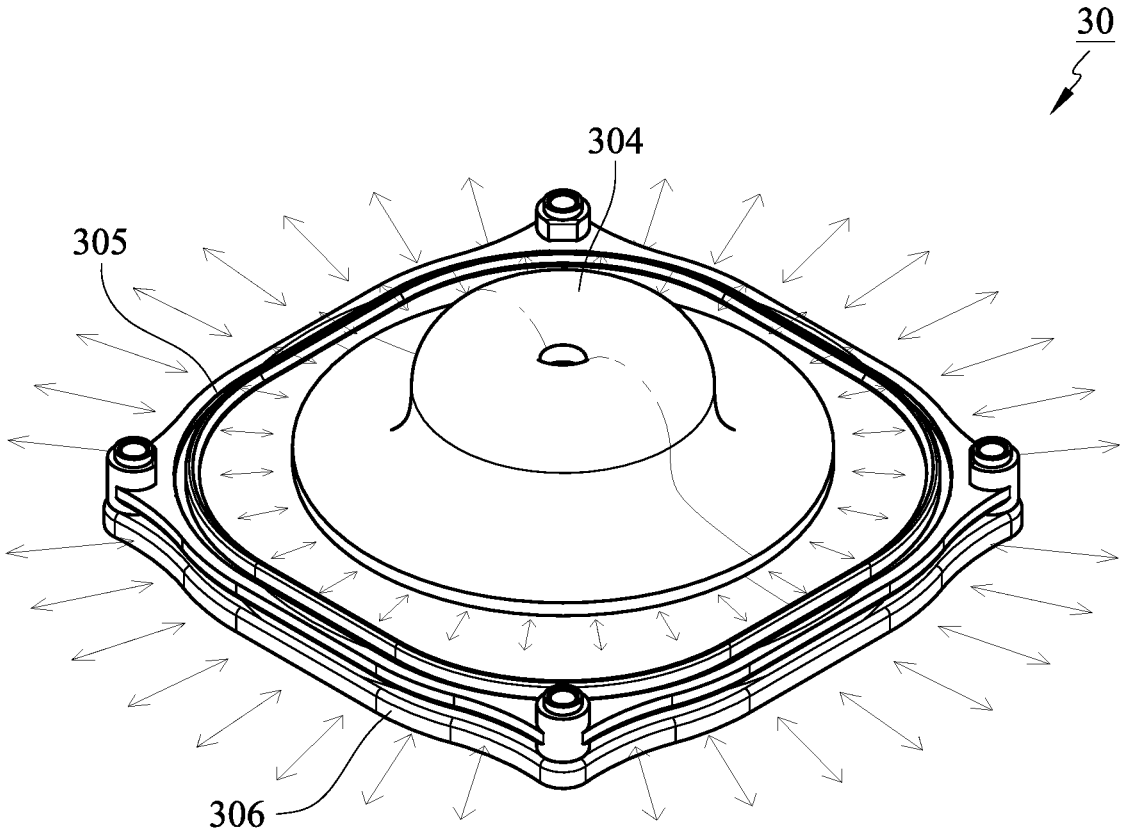
FIG. 3A is a perspective view of an inverter vent in accordance with another embodiment of the present disclosure.
Figure 3B:
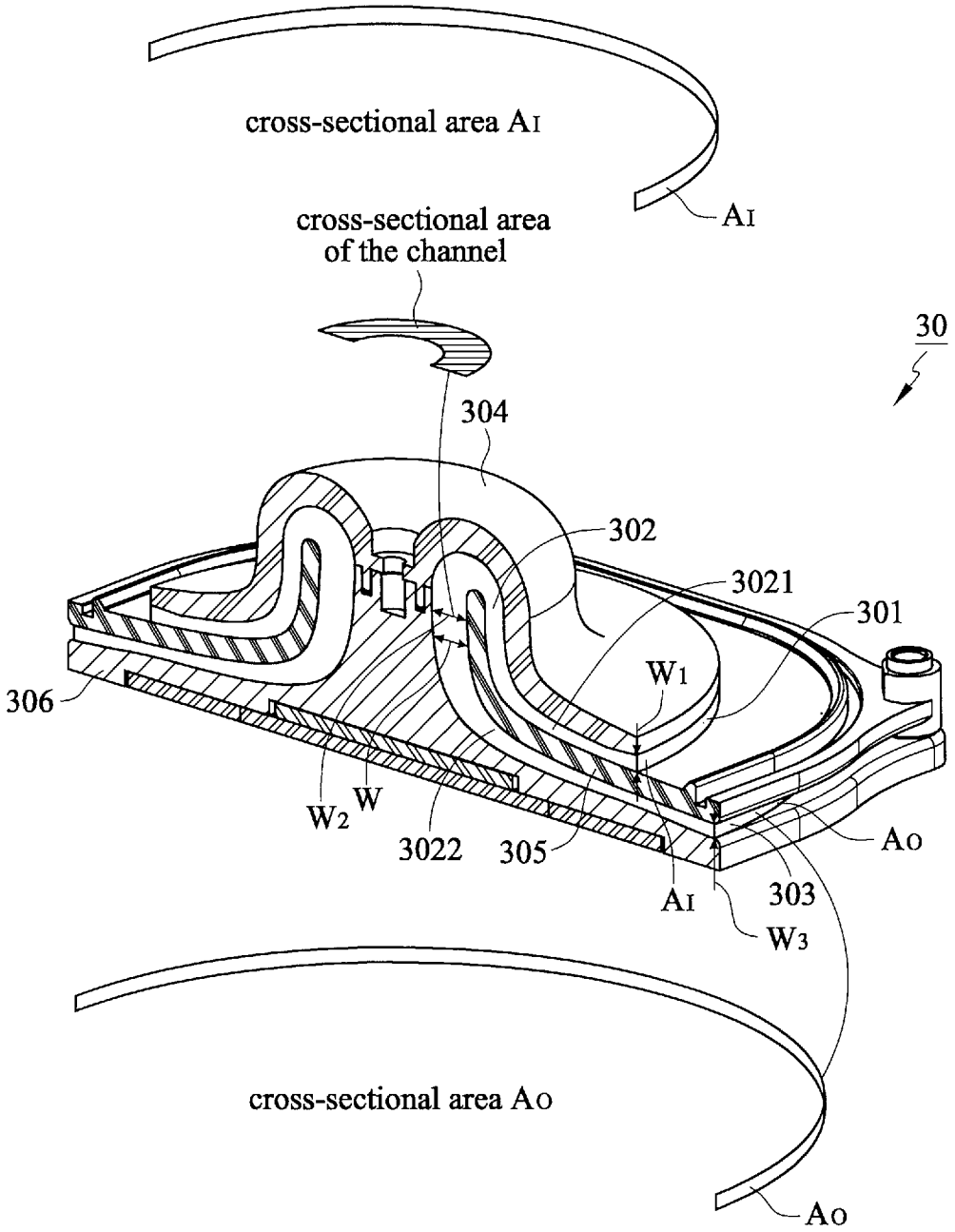
FIG. 3B is a cross-sectional view of the inverter vent shown in FIG. 3A.
Figure 3C:
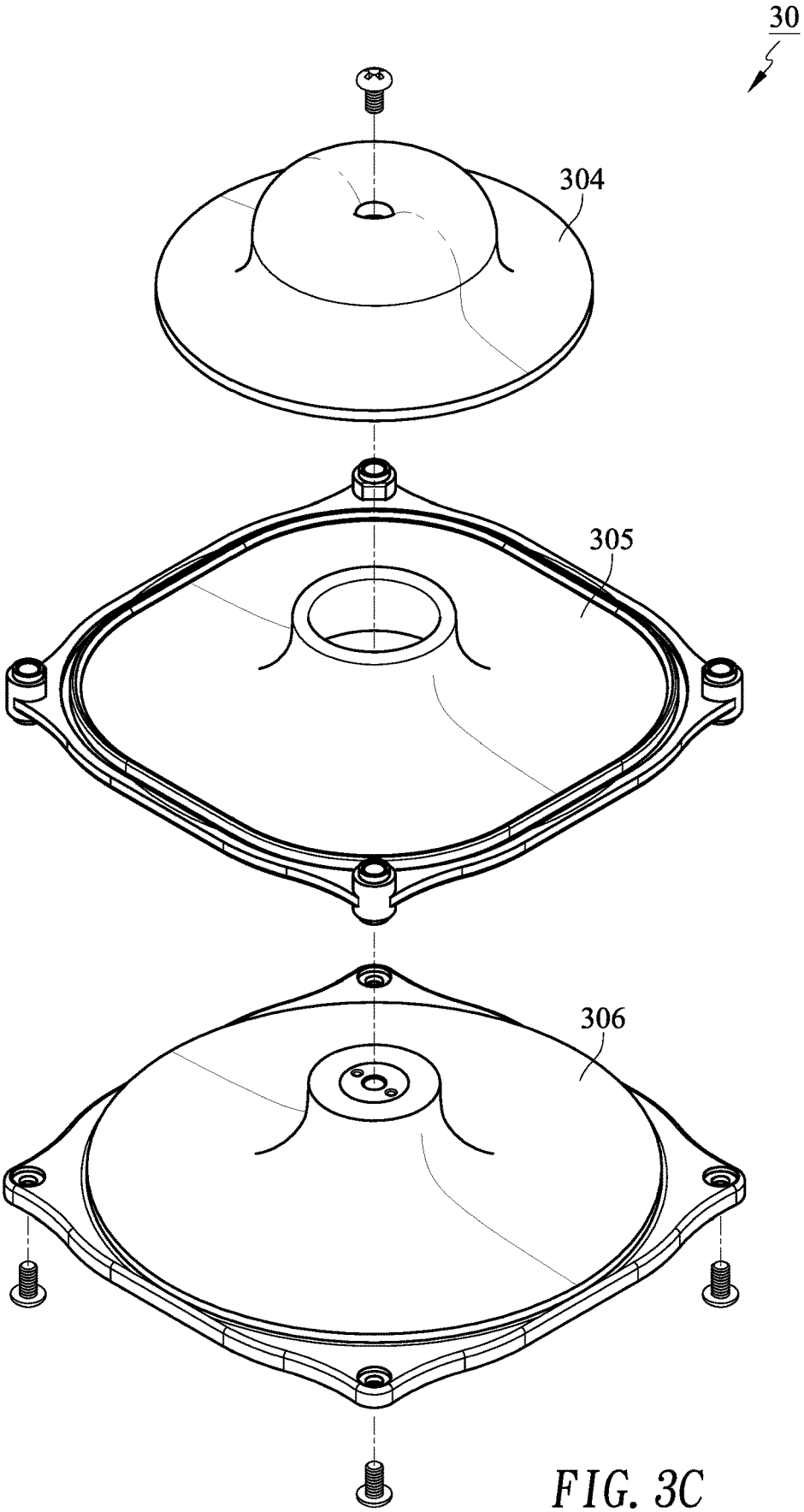
FIG. 3C is an exploded view of the inverter vent shown in FIG. 3A.
Figure 3D:
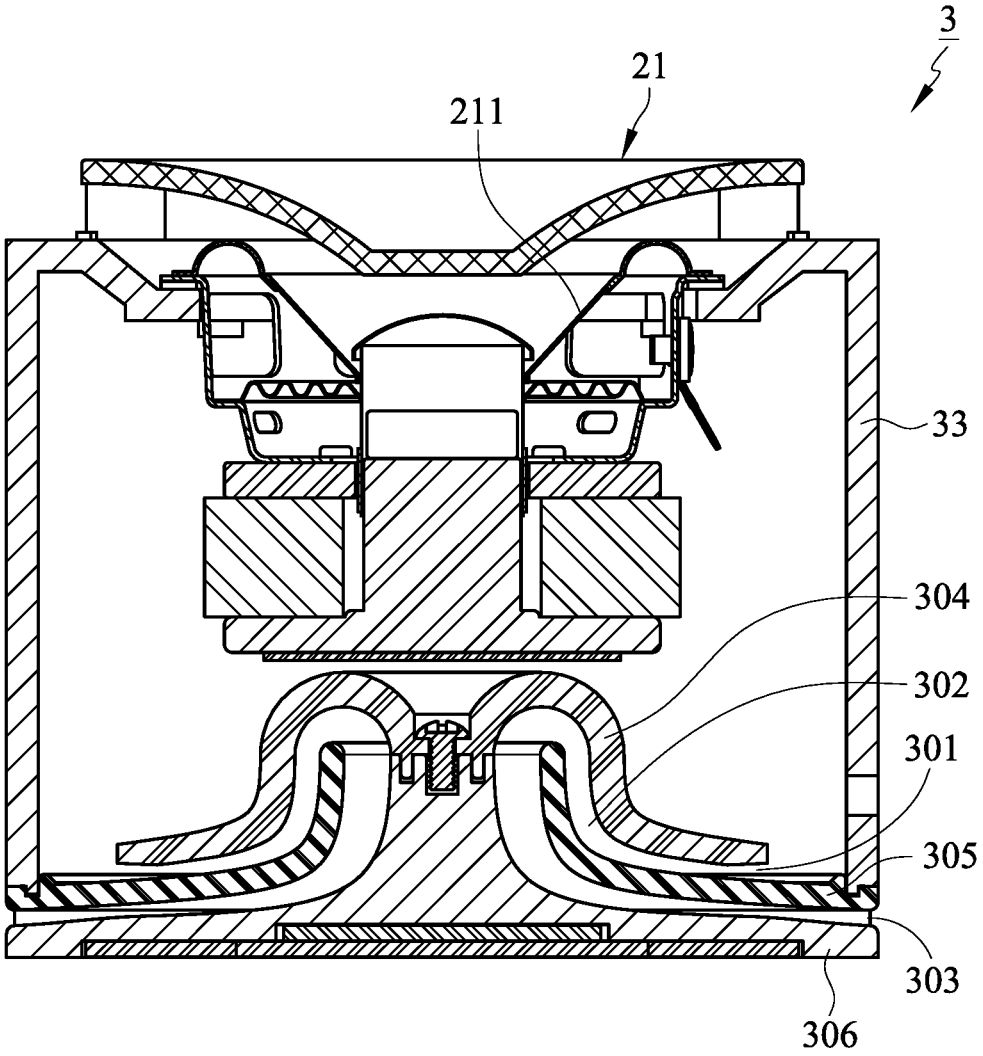
FIG. 3D is a cross-sectional view of a loudspeaker having the inverter vent shown in FIG. 3A in accordance with an embodiment of the present disclosure.

FIGS. 3A, 3B, and 3C are respectively perspective view, cross-sectional view, and exploded view of an inverter vent 30 in accordance with another embodiment of the present disclosure. FIG. 3D shows a loudspeaker 3 having the inverter vent 30 in accordance with an embodiment of the present disclosure.

Referring to FIGS. 3A-3D, the inverter vent 30 is disposed in the loudspeaker 3. The inverter vent 30 includes a 360° full-circumferential first opening 301, a channel 302, and a second opening 303. The channel 302 is communicated with the first opening 301, and the second opening 303 is communicated with the channel 302.

The loudspeaker 3 is provided with at least one monomer 21, which may include a diaphragm 211. When the diaphragm 211 vibrates inward, air inside the loudspeaker 3 enters the first opening 301 in a 360° full-circumferential direction, passes through the channel 302, and is then discharged through the second opening 303. When the diaphragm 211 vibrates outward, air outside the loudspeaker 3 enters the second opening 303, passes through the channel 302, and then passes through the first opening 301 and enters the loudspeaker 3 in a 360° full-circumferential direction.

In this embodiment, preferably, the second opening 303 is also a 360° full-circumferential opening. As shown by the double-headed arrow in FIG. 3A, the air inside the loudspeaker 3 is discharged from the second opening 303 in a 360° full-circumferential direction. Alternatively, air outside the loudspeaker 3 enters the second opening 303 in a 360° full-circumferential direction. In an embodiment, in order to match the product design of the loudspeaker 3 or for other reasons, the direction that air is discharged from or entered into the second opening 303 may not be 360° full-circumferential direction.

In this embodiment, both the cross-sectional area $A_I$ of the first opening 301 and the cross-sectional area $A_O$ of the second opening 303 of the inverter vent 30 are cylindrical. In one embodiment, preferably, a cross-sectional area of the channel 302 at its any position is substantially the same as a cross-sectional area of the first opening 301. In one embodiment, preferably, the second opening 303 has a cross-sectional area substantially the same as that of the first opening 301. That is, the cross-sectional area $A_I$ is substantially equal to the cross-sectional area $A_O$. In one embodiment, the first opening 301, the channel 302, and the second opening 303 have substantially the same cross-sectional area.

Referring to 3A to 3C, in this embodiment, the inverter vent 30 comprises a first partition 304, a second partition 305, and a third partition 306. The second partition 305 is located between the first partition 304 and the third partition 306. The first partition 304, the second partition 305, and the third partition 306 constitute the first opening 301, the channel 302, and the second opening 303 of the inverter vent 30.

Referring to 3A to 3C, the channel 302 is divided into a first channel 3021 and a second channel 3022 communicated with each other. The first partition 304 and the second partition 305 constitute the first opening 301 and the first channel 3021, and the second partition 305 and the third partition 306 constitute the second channel 3022 and the second opening 303. In order to obtain the required length of the channel 302, the first partition 304, the second partition 305, and the third partition 306 may be bent, spiral (convoluted) or have other shapes that can increase the path length. For example, in this embodiment, the first partition 304, the second partition 305, and the third partition 306 constitute the inverter vent 30, and the inverter vent 30 is volcanic cone-shaped. In some embodiments, a width W at the first opening 301, the second opening 303, and any position of the channel 302 may be different from one another. In other words, the distance W between the first partition 304 and the second partition 305 and the distance W between the second partition 305 and the third partition 306 may be a variable. For example, the width W2 at the middle of the channel 302 is greater the width W1 at the first opening W1, which is greater than the width W3 at the second opening 303, i.e., W2>W1>W1.

As shown in FIG. 3D, in this embodiment, the second partition 305 may be fixed to a wall 33 of the loudspeaker 3 and functions as a bottom of the loudspeaker 3. In addition, several fixing elements, such as screws, may be employed to fix the first partition 304, the second partition 305, and the third partition 306.

Figure 4:
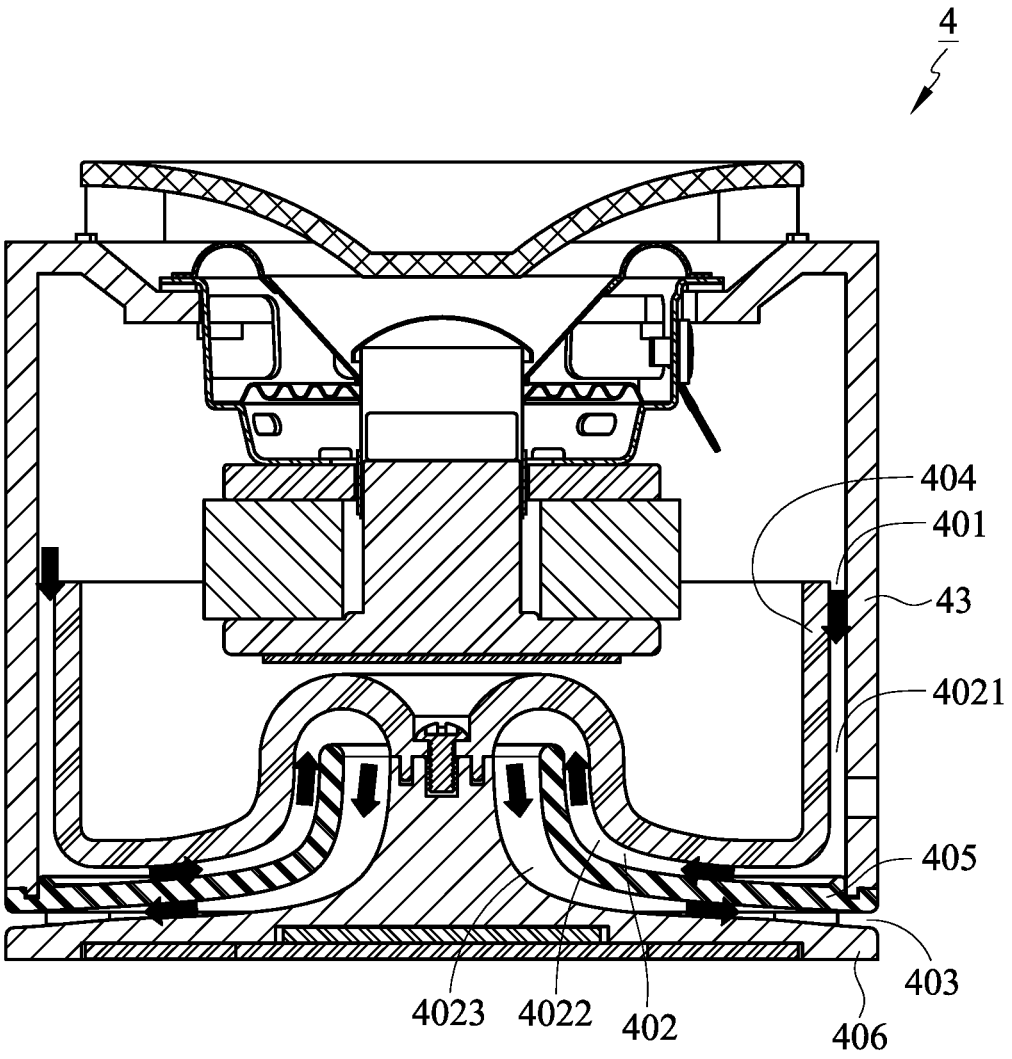
FIG. 4 is a cross-sectional view of a loudspeaker having an inverter vent in accordance with another embodiment of the present disclosure.

FIG. 4 shows a loudspeaker 4 having an inverter vent 40 in accordance with another embodiment of the present disclosure. In this embodiment, the inverter vent 40 has a configuration similar to the aforementioned inverter vent 30, and a first opening 401, a channel 402, and a second opening 403 of the inverter vent 40 is constituted by a first partition 404, a second partition 405, and a third partition 406. Air inside the loudspeaker 4 enters the first opening 401 in a 360° full-circumferential direction, passes through the channel 402, and then is discharged through the second opening 403. Alternatively, air outside the loudspeaker 4 enters the second opening 403, passes through the channel 402, and enters the loudspeaker 4 through the first opening 401 in a 360° full-circumferential direction.

Referring to FIG. 4, the channel 402 is divided into a first channel 4021, a second channel 4022, and a third channel 4023 communicated with each other. The first partition 404 and a wall 43 of the loudspeaker 4 constitute a first channel 4021 and a first opening 401, the first partition 404 and the second partition 405 constitute a second channel 4022, and the second partition 405 and the third partition 406 constitute the third channel 4023 and the second opening 403.

Figure 5:
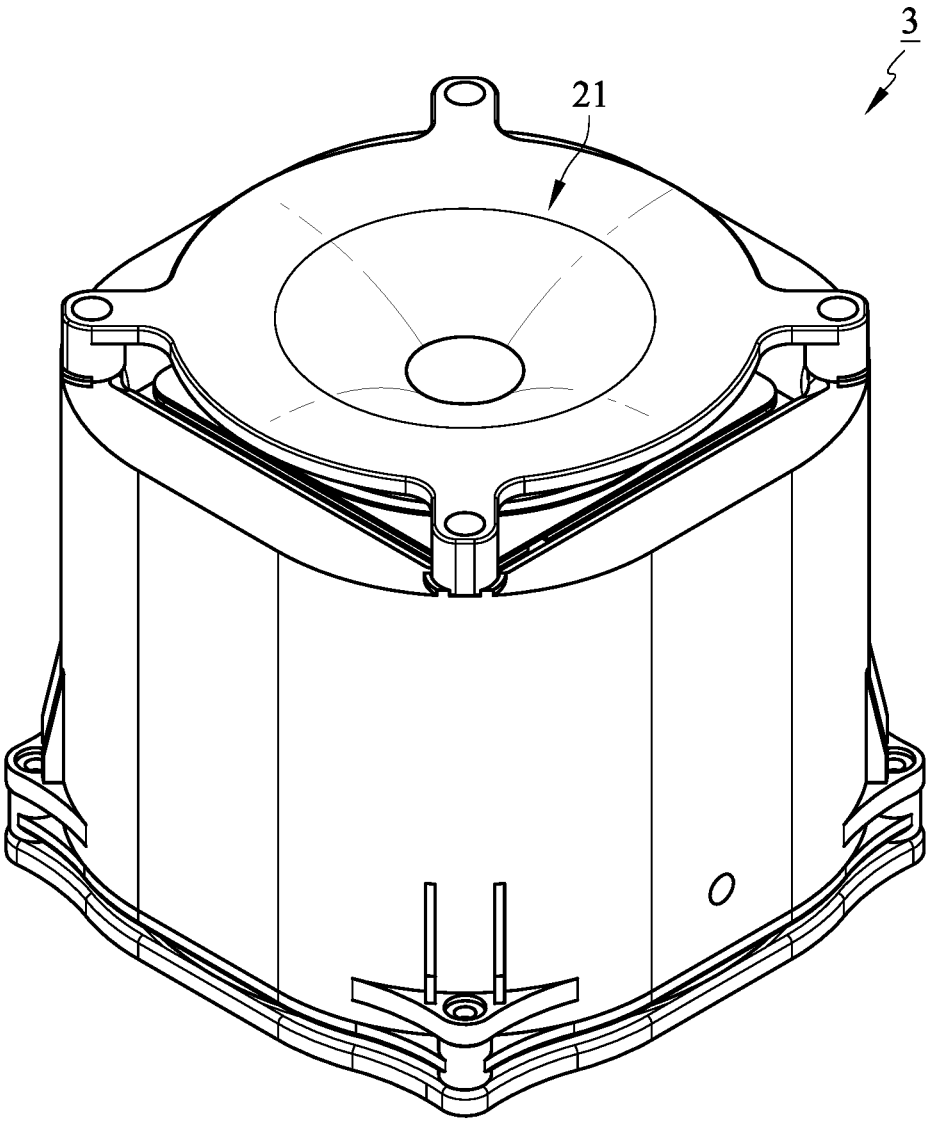
FIG. 5 is a perspective view of a loudspeaker in accordance with an embodiment of the present disclosure.

FIG. 5 illustrates a perspective view of a loudspeaker 3 in accordance with an embodiment of the present disclosure. The same design can also be used for the aforementioned loudspeaker 2 or loudspeaker 4.

Figure 6:
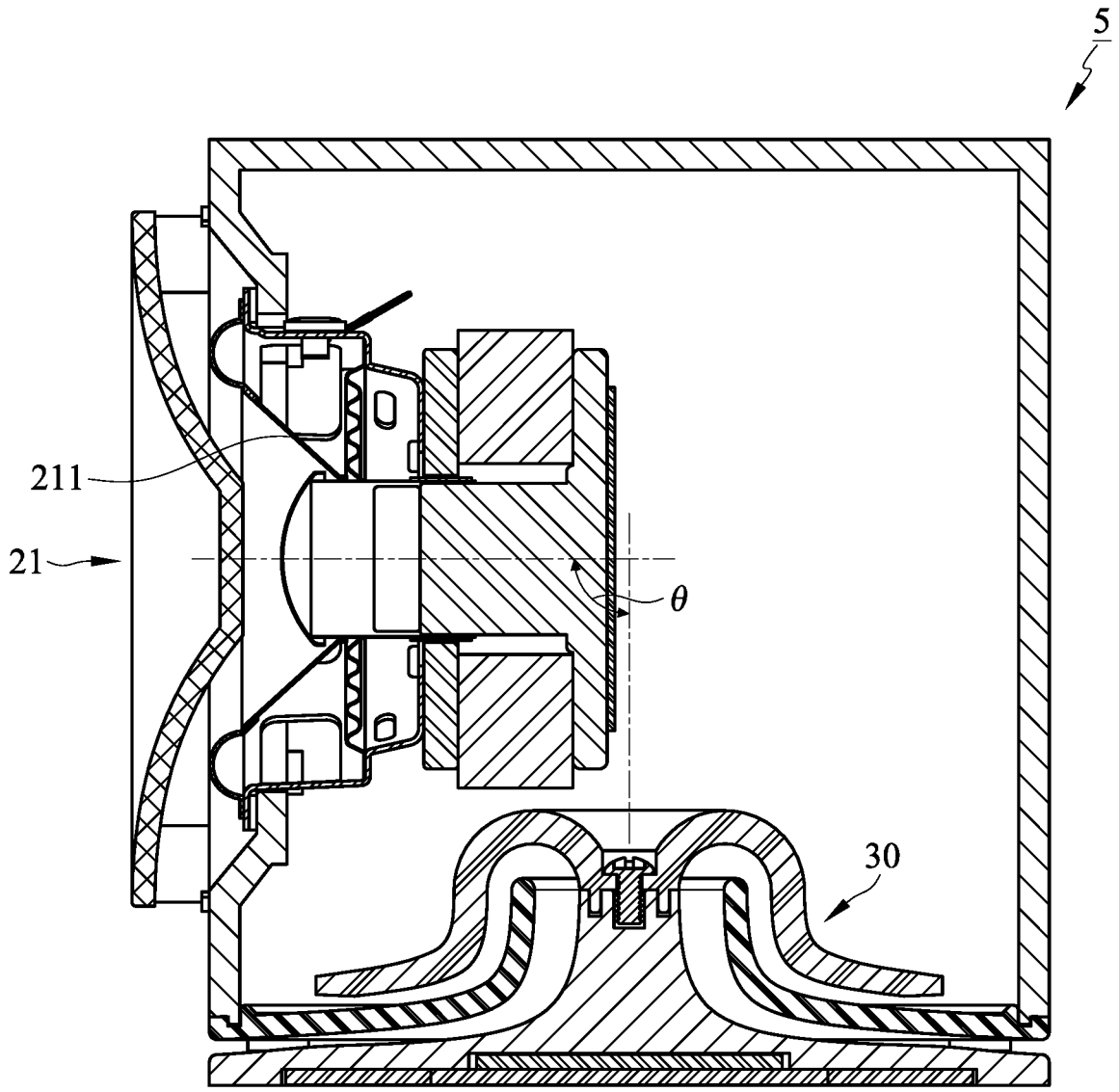
FIG. 6 is a cross-sectional view of a loudspeaker having an inverter vent in accordance with another embodiment of the present disclosure.

In the foregoing embodiments, an axis of the monomer 21 in the loudspeaker is parallel to an axis of the inverter vent. However, in some embodiments, an angle θ may be formed by the axis of the monomer and the axis of the inverter vent. For example, FIG. 6 shows a loudspeaker 5 in accordance with another embodiment of the present disclosure, in which an angle θ of 90° is formed by the axis of the monomer 21 and the axis of the inverter vent 30. Experimental results show that this configuration does not affect the performance of the loudspeaker 5.

Figure 7:
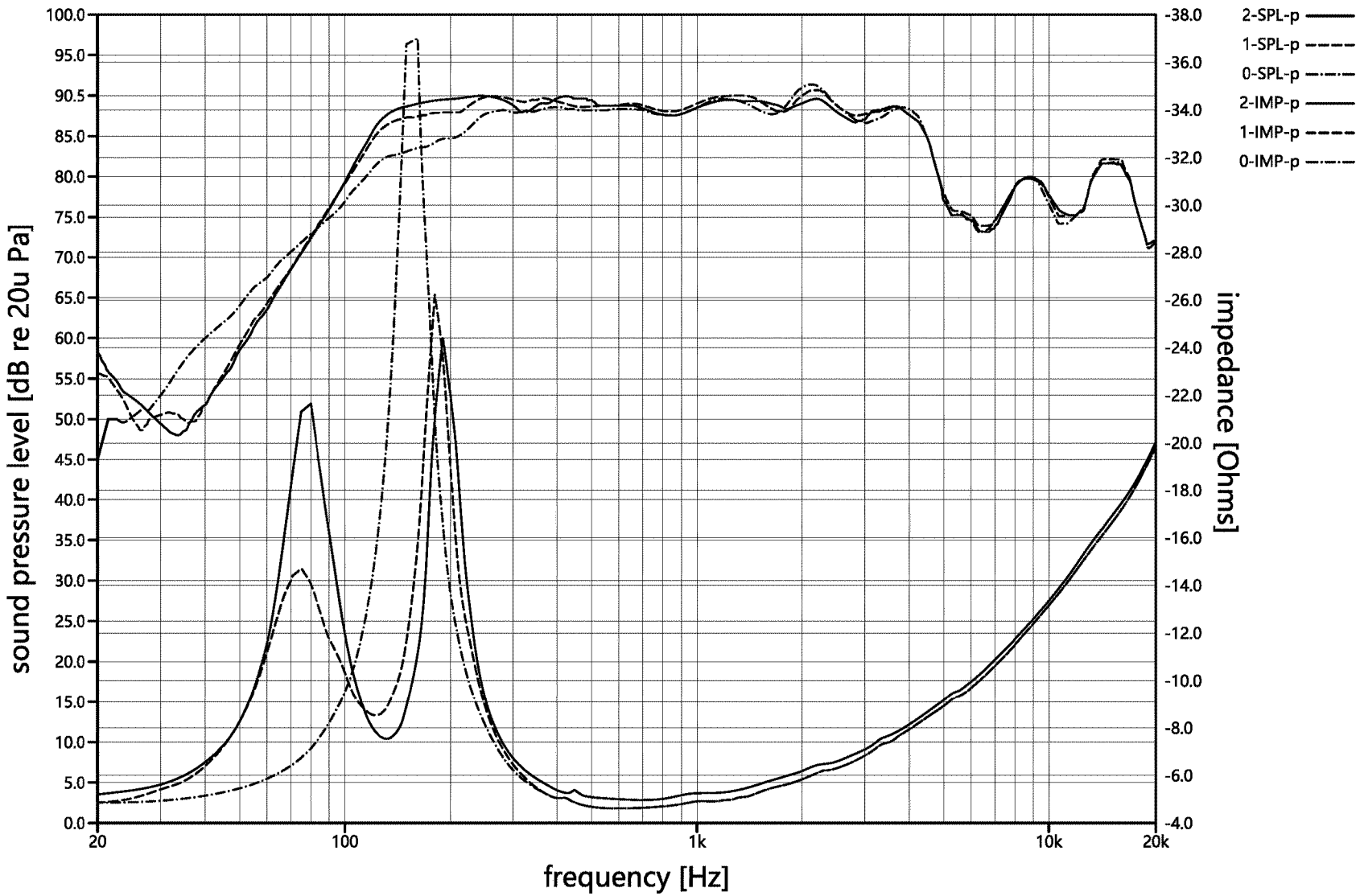
FIG. 7 shows a sound pressure level test and an impedance test of a loudspeaker having an inverter vent in accordance with an embodiment of the present disclosure.

FIG. 7 shows results of a sound pressure level test and an impedance test of a loudspeaker having an inverter vent in accordance with an embodiment of the present disclosure. Both tests were performed using the loudspeaker 3 having the inverter vent 30 shown in FIGS. 3A-3D. Where the "O-SPL" curve is the sound pressure (dB) of the sound wave of enclosed loudspeaker 3 (excluding the inverter vent 30).

The "1-SPL" curve is the sound pressure of the loudspeaker 30 with the inverter vent 3. It can be seen from the test results that the sound pressure at low frequencies is significantly increased; confirming that the inverter vent 30 is effective. The "2-SPL" is also the sound pressure curve of the loudspeaker 3 with the inverter vent 30, where the width W of the second opening 303 is increased by using spacers. And it can be seen from the test results that the sound pressure at low frequencies is slightly increased. The lower "0-IMP", "1-IMP", and "2-IMP" are the corresponding impedance curves of "0-SPL", "1-SPL", and "2-SPL." The test results can confirm that the inverter vent 30 can work as common inverter tubes.

According to the inverter vents provided by embodiments of the present disclosure, air flows in a 360 degrees direction without a specific angle, so that the second opening or the first opening can be prevented from being blocked by mechanism of the loudspeaker, thereby reducing the wind noise.

In addition, the inverter vents provided by embodiments of the present disclosure can be bent or twisted, so that the required length of the inverter vent can be easily achieved, and the inverter vent is not easily affected by the profile and the internal mechanism of the loudspeaker.

Furthermore, the overall structure of the inverter vent provided by embodiments of the present disclosure can be 360-degree symmetrical, so the product design of the loudspeaker can combine the inverter vent with a casing of the loudspeaker. In contrast, conventional inverter vents usually form a single opening in the casing of the loudspeaker; however the opening usually is not disposed at a symmetrical position and hence affects the aesthetics of the product.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the disclosure. Corresponding or related structure and methods disclosed or referenced herein, and/or in any and all co-pending, abandoned or patented application(s) by any of the named inventor(s) or assignee(s) of this application and disclosure, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present disclosure according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this disclosure. Corresponding or related structure and methods specifically contemplated and disclosed herein as part of this disclosure, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present disclosure according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present disclosure, which is intended to be limited solely by the appended claims.

What is claimed is:

1. A volcanic cone-shaped inverter vent being arranged in a bass reflex loudspeaker and comprising:

a 360 degrees full-circumferential first opening;

a channel communicated with the first opening; and a second opening communicated with the channel;

wherein air enters or exits from the 360 degrees full-circumferential first opening in a 360 degrees full-circumferential direction, and a width of the channel is gradually varied along the channel; and wherein the second opening is a 360 degrees full-circumferential opening, air inside the loudspeaker is discharged from the second opening in a 360 degrees full-circumferential direction; alternatively, air outside the loudspeaker enters the second opening in a 360 degrees full-circumferential direction.

2. The inverter vent as recited in claim 1, wherein a cross-sectional area of the channel is substantially the same as a cross-sectional area of the 360 degrees full-circumferential first opening.

3. The inverter vent as recited in claim 1, wherein a cross-sectional area of the second opening is substantially the same as a cross-sectional area of the 360 degrees full-circumferential first opening.

4. A volcanic cone-shaped inverter vent being arranged in a loudspeaker and comprising:

a first partition; and a second partition;

wherein the first partition and the second partition constitute a 360 degrees full-circumferential first opening, a channel, and a second opening, air inside the loudspeaker enters the 360 degrees full-circumferential first opening in a 360° full circumference direction, and passes through the channel, and then is discharged through the second opening; alternatively, air outside the loudspeaker enters the second opening, and passes through the channel, and then enter the loudspeaker through the 360 degrees full-circumferential first opening in a 360 degrees full-circumferential direction;

wherein the second opening is a 360 degrees full-circumferential opening, air inside the loudspeaker is discharged from the second opening in a 360 degrees full-circumferential direction; alternatively, air outside the loudspeaker enters the second opening in a 360 degrees full-circumferential direction; and wherein a width of the channel is gradually varied along the channel.

5. The inverter vent as recited in claim 4, further comprising a third partition, wherein:

the second partition is located between the first partition and the third partition;

the channel is divided into a first channel and a second channel communicated with each other;

the first partition and the second partition constitute the 360 degrees full-circumferential first opening and the first channel; and the second partition and the third partition constitute the second channel and the second opening.

6. The inverter vent as recited in claim 4, further includes a third partition, wherein:

the channel is divided into a first channel, a second channel, and a third channel communicated with each other;

the first partition and a wall of the loudspeaker constitute the first channel and the 360 degrees full-circumferential first opening, the first partition and the second partition constitute the second channel, and the second partition and the third partition constitute the third channel and the second opening.

7. The inverter vent as recited in claim 4, wherein a cross-sectional area of the channel is substantially the same as a cross-sectional area of the 360 degrees full-circumferential first opening.

8. The inverter vent as recited in claim 4, wherein a cross-sectional area of the second opening is substantially the same as a cross-sectional area of the 360 degrees full-circumferential first opening.

9. A bass reflex loudspeaker, comprising:

a monomer having a diaphragm;

a volcanic cone-shaped inverter vent being separated from the monomer and comprising:

a 360 degrees full-circumferential first opening;

a channel communicated with the first opening; and a second opening communicated with the channel;

wherein air inside the loudspeaker enters the 360 degrees full-circumferential first opening in a 360 degrees full-circumferential direction, and passes through the channel, and then is discharged through the second opening; alternatively, air outside the loudspeaker enters the second opening, and passes through the channel, and then enter the loudspeaker through the first opening in a 360 degrees full-circumferential direction;

wherein the second opening is a 360 degrees full-circumferential opening, and air inside the loudspeaker is discharged from the second opening in a 360 degrees full-circumferential direction; alternatively, air outside the loudspeaker enters the second opening in a 360 degrees full-circumferential direction; and wherein an axis of the monomer is parallel to an axis of the inverter vent or an angle is formed by the axis of the monomer and the axis of the inverter vent, and wherein a width of the channel is gradually varied along the channel.

10. The loudspeaker as recited in claim 9, wherein a cross-sectional area of the channel is substantially the same as a cross-sectional area of the 360 degrees full-circumferential first opening.

11. The loudspeaker as recited in claim 9, wherein a cross-sectional area of the second opening is substantially the same as a cross-sectional area of the 360 degrees full-circumferential first opening.

12. The loudspeaker as recited in claim 9, wherein the inverter vent comprises a first partition and a second partition, and the first partition and the second partition constitute the 360 degrees full-circumferential first opening, the channel, and the second opening, and wherein the first partition is connected to a wall of the loudspeaker.

13. The loudspeaker as recited in claim 9, wherein the inverter vent comprises:

a first partition;

a second partition; and a third partition;

wherein the second partition is located between the first partition and the third partition, the channel is divided into a first channel and a second channel communicated with each other, the first partition and the second partition constitute the first opening and the first channel, the second partition and the third partition constitute the second channel and the second opening, and the second partition is connected to a wall of the loudspeaker.

14. The loudspeaker as recited in claim 9, wherein the inverter vent comprises:

a first partition;

a second partition; and a third partition, wherein the second partition is located between the first partition and the third partition, the channel is divided into a first channel, a second channel, and a third channel communicated with each other, the first partition and a wall of the loudspeaker constitute the first channel and the first opening, the first partition and the second partition constitute the second channel, the second partition and the third partition constitute the third channel and the second opening, and the second partition is connected to the wall of the loudspeaker.

* * * * *